United States Patent [19]

Dennison et al.

[11] Patent Number: 4,525,694

[45] Date of Patent: Jun. 25, 1985

[54] ELECTROMAGNETIC CONTACTOR

[75] Inventors: William G. Dennison, Cedarburg; Kenneth R. Horr, Shorewood; Robert I. Kindler, Grafton, all of Wis.

[73] Assignee: Eaton Corporation, Cleveland, Ohio

[21] Appl. No.: 535,107

[22] Filed: Sep. 23, 1983

[51] Int. Cl.[3] ..... H01H 50/02

[52] U.S. Cl. ..... 335/132; 335/131

[58] Field of Search ..... 335/131, 132, 133

[56] References Cited

U.S. PATENT DOCUMENTS

| | | | |
|---|---|---|---|
| 2,924,685 | 2/1960 | Burch | 200/104 |
| 3,066,277 | 11/1962 | Edmunds | 339/245 |
| 3,178,534 | 4/1965 | Bundy et al. | 335/132 |
| 3,215,800 | 11/1965 | Hurter et al. | 335/131 |
| 3,451,018 | 6/1969 | Di Marco | 335/131 |
| 3,806,849 | 4/1974 | Hughes | 335/201 |
| 4,371,855 | 2/1983 | Lenzing | 335/132 |

*Primary Examiner*—E. A. Goldberg
*Assistant Examiner*—George Andrews
*Attorney, Agent, or Firm*—C. H. Grace; W. A. Autio

[57] ABSTRACT

The parts of the three-pole contactor (FIGS. 1 and 2) are designed so as to enable economical assembly thereof without any screws or similar fasteners. A molded contact carrier (12) having windows (12*a–c*) that retain movable bridging contacts (14, 16, 18) and their bias springs (20, 22, 24) and armature (28) seat (12*i*) and snap-in securing ramps (12*k*, 12*m*) that retain a leaf spring (26) extending through a slot (28*a*) in the armature (28) forms a subassembly that is inserted into an upper housing part (2) that has slots (2*v*, 2*w*, 2*x*) into which stationary contacts (6, 8, 10) are inserted. An encapsulated coil subassembly (38) having terminals (42, 44), a bobbin (40) and a coil (4) and a return spring (36) snap-in assembled thereon is placed over the armature (28). An E-shaped magnet (46) having shading coils (48, 50) on its poles is inserted through the holes in the coil assembly (38). A frame (52) is placed over the magnet (46) and snap-in coupled to the upper housing part (2) to complete the assembly of the contactor.

Thin portions (38*r*) on the legs (38*m*, 38*n*, 38*p*, 38*q*) of the molding material encased coil (38) are resiliently deformed as the frame is pressed into snap-in engagement to take up any looseness between the parts.

18 Claims, 20 Drawing Figures

Fig. 1
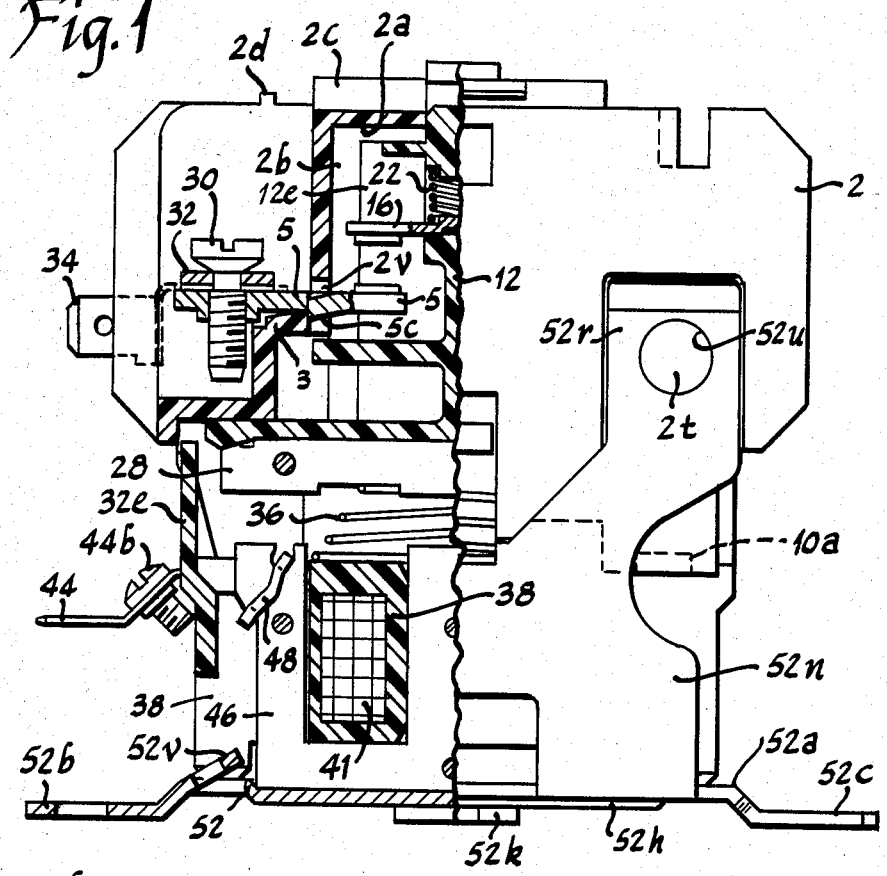
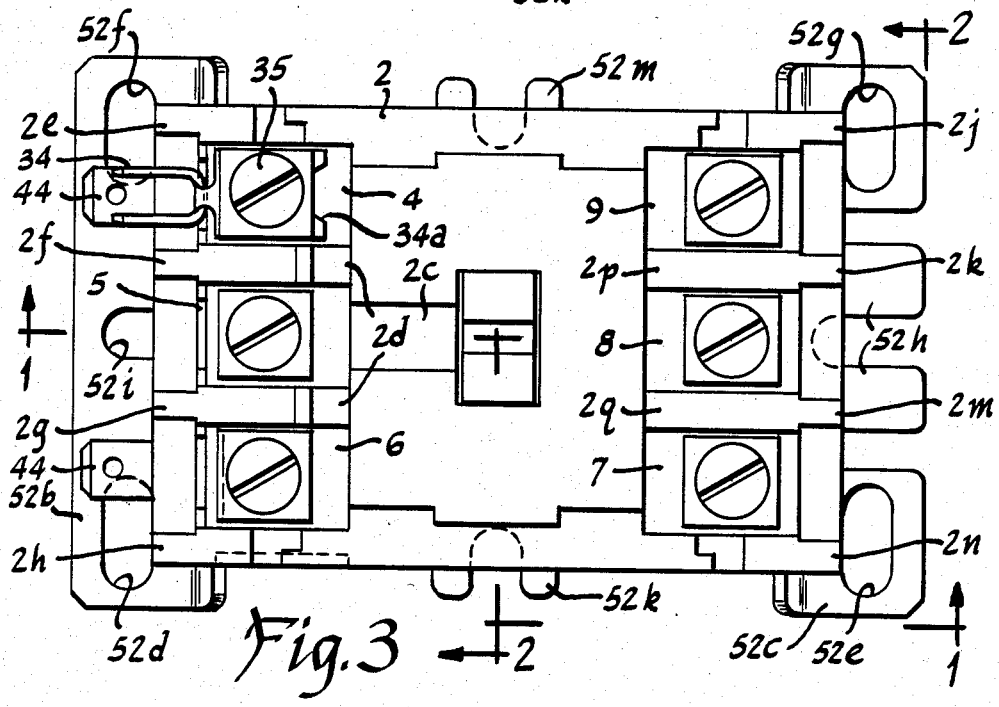
Fig. 3

Fig. 17
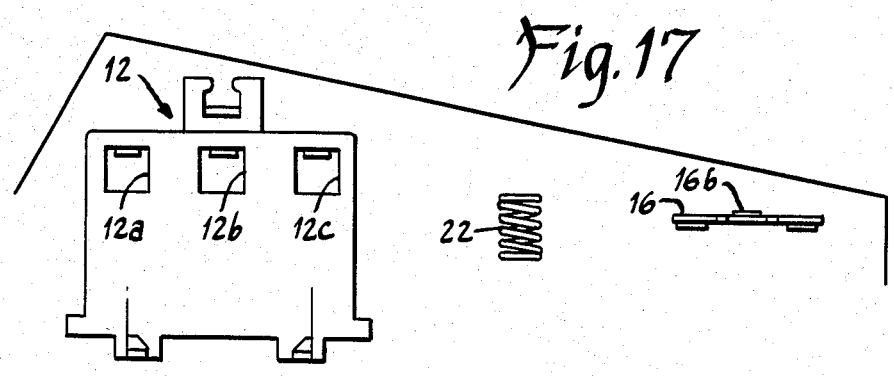
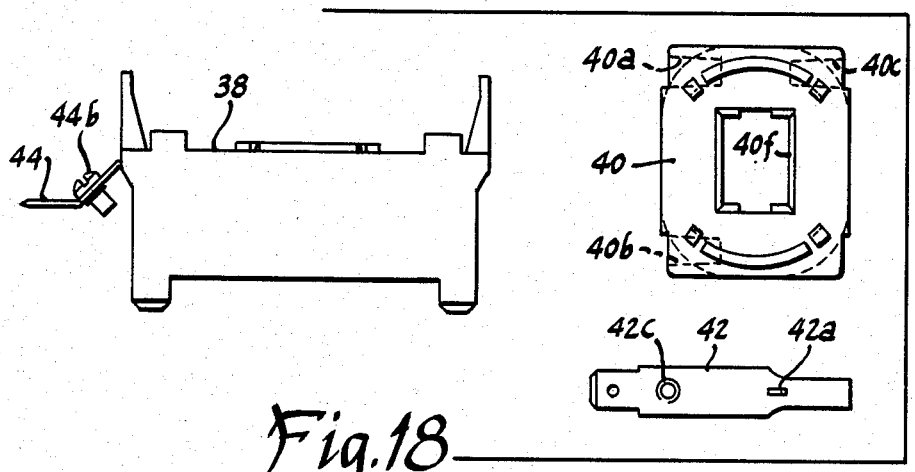
Fig. 18
Fig. 19
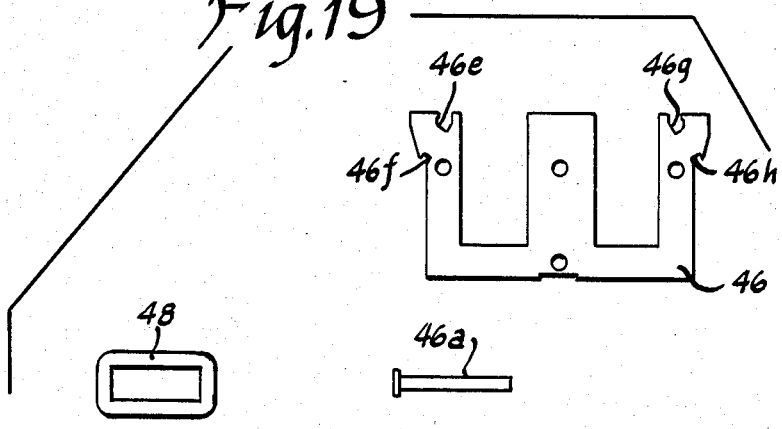

ELECTROMAGNETIC CONTACTOR

BACKGROUND OF THE INVENTION

Electromagnetically operated contactors and methods of making the same have been known heretofore. However, contactors of that type have been generally handicapped by being rather complex in structure and difficult and costly to manufacture and assemble. As an example, contactors of this general type have generally been designed to use screws for attaching the stationary contacts to the housing which entails not only additional parts but also complicated and costly manual operations to assemble. Also, in prior art contactors of this type, complex means such as screws or the like have generally been used for attaching the mounting frame or mounting plate to the contactor housing. Similar complex arrangements have generally been used for attaching the armature to the contact carrier and for positioning and securing the electromagnet which includes the magnetic frame and the operating coil. All of such prior designs of contactors require complex and costly manual operations not only to preassemble some of the parts but also to put the final assembly together. Accordingly, it has been found desirable to provide an improved contactor structure that enables the contactor to be completely assembled without screws or other fasteners and by stacking the parts and certain subassemblies one upon another and then clamping them all together into fixed relationship by a snap-in supporting and mounting frame.

SUMMARY OF THE INVENTION

An object of the invention is to provide an improved electromagnetic contactor.

Another object of the invention is to provide an improved structure and method of making an electromagnetic contactor.

A more specific object of the invention is to provide an improved electromagnetic contactor that is so designed as to enable economical or automated assembly thereof.

Another specific object of the invention is to provide an improved electromagnetic contactor that affords easy assembly thereof without screws or other fasteners by stacking the parts and certain subassemblies one upon another and then clamping them all together by snap-in supporting and mounting means.

Another specific object of the invention is to provide an electromagnetic contactor of the aforementioned type with improved biasing means between the snap-in frame and the encapsulated coil to insure take-up of any looseness or play therebetween.

Another specific object of the invention is to provide an electromagnetic contactor of the aforementioned type with improved means for securing the armature to the contact carrier.

Another specific object of the invention is to provide a contactor of the aforementioned type with improved means for mounting and retaining the stationary contact terminals in the insulating upper housing.

Other objects and advantages of the invention will hereinafter appear.

BRIEF DESCRIPTION OF THE DRAWINGS

FIG. 1 shows an enlarged front side view, onehalf in cross section substantially along line 1—1 of FIG. 3, of an assembled electromagnetic contactor constructed in accordance with the invention.

FIG. 3 shows a top view of the electromagnetic contactor of FIG. 1.

FIG. 17 is an exploded view in actual size of the parts of the contact carrier subassembly.

FIG. 18 is an exploded view in actual size of the parts of the encapsulated coil subassembly.

FIG. 19 is an exploded view in actual size of the parts of the magnet frame subassembly.

DESCRIPTON OF THE PREFERRED EMBODIMENT

Figure 2:
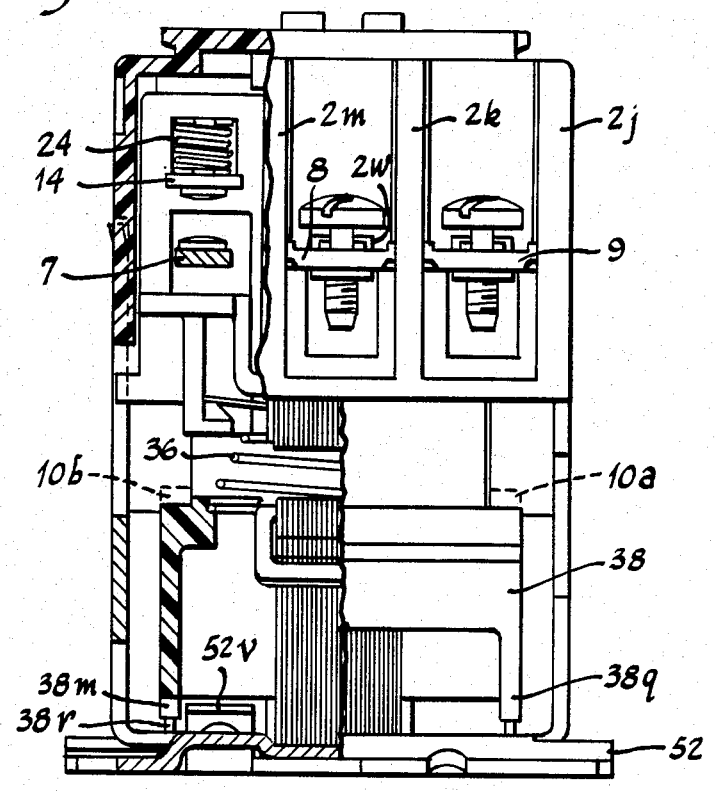
FIG. 2 shows a right end view, partly in cross section substantially along line 2—2 of FIG. 3, of the electromagnetic contactor of FIG. 1.

Referring to FIGS. 1–3, there is shown a three-pole electromagnetic contactor constructed in accordance with the invention. As shown therein, the contactor is provided with a molded insulating upper housing part 2 having an upwardly extending, three section contact compartment **2*a* therein, the three sections of the contact compartment being partially separated by two pairs of arc barriers 2*b* extending from the left and right walls of the contact compartment partway toward the middle. For a three-pole contactor of the type illustrated in FIGS. 1–3, there will be two sets of three stationary contacts, the first set of contacts 4, 5 and 6 being shown in FIGS. 1 and 3 and stationary contacts 7, 8 and 9 of the second set being shown in FIGS. 2 and 3**, one such set extending from the left end of the housing into the contact compartment and the other set extending from the right end of the housing into the contact compartment, there being three stationary contacts in each such set with respective stationary contacts of the two sets extending into the three sections of the contact compartment, respectively.

Figure 4:
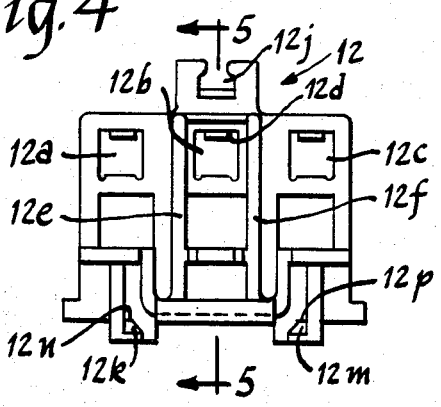
FIG. 4 is a left end, actual size view of the contactor carrier of the electromagnetic contactor of FIG. 1, the term left end having reference to the orientation of the parts as seen in FIG. 1.
Figure 5:
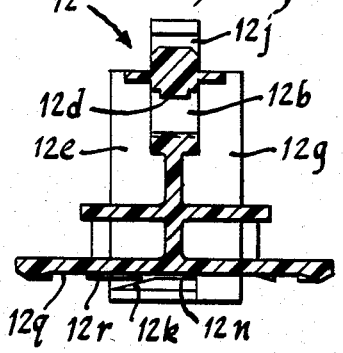
FIG. 5 is a cross sectional view of the contact carrier taken substantially along line 5—5 of FIG. 4.
Figure 9:
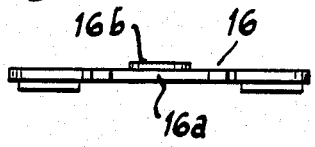
FIG. 9 is an enlarged front side view of one of the three movable contacts used in the contactor of FIG. 1.
Figure 10:
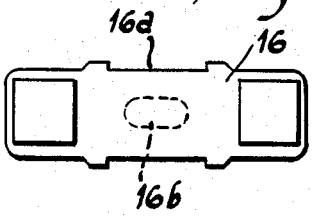
FIG. 10 is an enlarged bottom view of one of the three movable contacts used in the contactor of FIG. 1.

A molded insulating contact carrier 12 is slideably accommodated within contact compartment 2*a* in the housing and has complementary abutments with the inner walls of the contact compartment in the housing so that it can be vertically reciprocated under the force of an electromagnet and return spring hereinafter described. As shown in FIGS. 4 and 5, contact carrier 12 is provided with three windows 12*a*, 12*b* and 12*c* for retaining movable bridging contacts 14, 16 and 18 as shown at the lower left-hand portion of FIG. 20. For this purpose, the movable bridging contacts have shallow notches 16*a* centrally on opposite edges as shown in FIGS. 9 and 10 so that when turned on edge and inserted into the window and then allowed to fall horizontally to the bottom of the window, each contact will lock in place and cannot be moved longitudinally with respect to the contact carrier. As shown in FIGS. 9, 10 and 17, each movable bridging contact has an upset portion 16*b* formed at its middle for retaining the lower end of a helical compression spring 20, 22, 24, FIG. 20, and the contact carrier has a round molded projection 12*d*, FIGS. 4 and 5, at the top of each window for retaining the upper end of the helical compression spring. In this manner, the movable bridging contacts can be moved upwardly in their windows against the force of their respective compression springs to provide contact force and overtravel when the contacts close.

Figure 8:
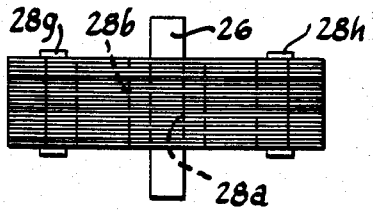
FIG. 8 is a top view of the armature subassembly and retaining spring of FIG. 7.
Figure 20:
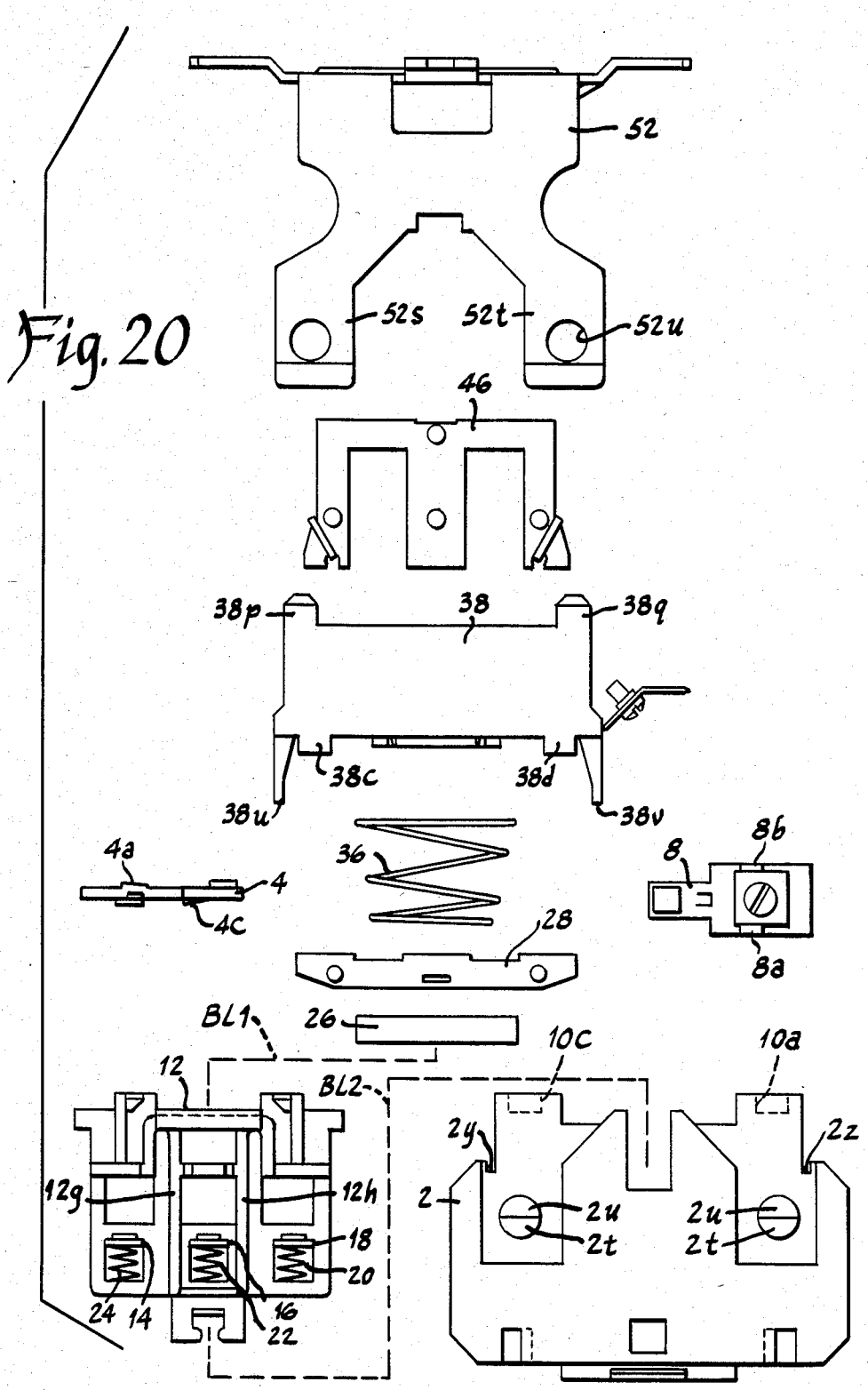
FIG. 20 is an exploded view in actual size of all of the parts and subassemblies that are used to assemble the contactor of FIG. 1.

Contact carrier 12 is also provided with a pair of spaced left arc barriers 12*e* and 12*f*, FIG. 4, and a pair of spaced right arc barriers 12*g* and 12*h*, FIG. 20, that slide up between and in close proximity to the corresponding pairs of arc barriers 2*b* within the housing and in overlapping relation thereto to completely separate the three sections of the contact compartment to isolate the three bridging contacts from one another. As shown in FIGS. 4 and 5, contact carrier 12 is also provided at its upper portion with a coupling slot 12*j* for the actuator of an auxiliary top-adder contact device or the like which is slid into place laterally along channel 2*c* at the top of the housing, FIGS. 1–2, and snapped into place on ridges 2*d* at the top of the housing. Contact carrier 12 is furthermore provided at its lower portion with securing means for an armature retaining leaf spring 26 shown in FIG. 8. This securing means comprises a pair of spaced ramps 12*k* and 12*m* shown in FIG. 4 which terminate in respective horizontal ledges 12*n* and 12*p*. Armature retaining spring 26 shown in FIG. 8 is inserted through slot 28*a* of armature 28 and then the ends of this leaf spring 26 are forced up ramps 12*k* and 12*m* all the way to horizontal ledges 12*n* and 12*p* to retain the armature clamped to the bottom of the contact carrier. The bottom of the contact carrier is provided with an elongated armature seat 12*q*, FIG. 5, substantially coextensive with elongated flat armature 28 and complementary with the upper surface of the armature. Opposite side portions of this armature seat are provided with low lugs 12*r* shown in FIG. 5 past which the ends of leaf spring 26 are pushed to keep it from coming out.

Figure 6:
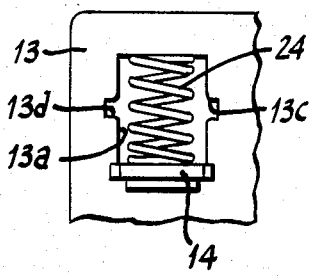
FIG. 6 is a fragmentary view of a modification of the contact carrier of FIGS. 4 and 5.

A modification of the contact carrier of FIGS. 4 and 5 is shown in FIG. 6. As shown therein, this modified contact carrier 13 is provided with three movable bridging contact supporting windows which are alike, one window 13*a* being shown in FIG. 6. As will be apparent, this window 13*a* is configured so that the movable bridging contact need not be turned on edge for entry thereinto but instead can be inserted directly through the vertically midportion of the window. For this purpose, this window 13*a* is provided with a pair of slots 13*b* and 13*c* at opposite sides thereof to provide a passageway wide enough to freely pass the movable bridging contact when it is oriented in a horizontal plane. The movable bridging contact is inserted halfway through the window 13*a* at these side slots and is then moved or dropped to the bottom of the window whereby the contact will lock in place at its side notches 16*a*, FIG. 10, so that it can move partway up in normal operation and back down but cannot be moved out of the window longitudinally. The helical compression spring is then assembled above the contact within the window as hereinbefore described.

From the foregoing, it will be apparent that the movable bridging contacts and their retaining springs are assembled onto the contact carrier and the armature retaining leaf spring is inserted through the slot in the armature and the ends of this leaf spring pressed into place at the bottom of the contact carrier in the desired order whereafter the contact carrier and armature subassembly is inserted into the switch compartment in the housing. Thereafter, the three left stationary contacts 4, 5 and 6 shown in FIG. 2 and the similar right stationary contacts 7, 8 and 9 are pressed through their holes in the housing into underlying relation with the opposite ends of the corresponding movable bridging contacts.

The stationary contact-terminals are retained locked in the housing without any additional screws or the like fasteners. For this purpose, each stationary contact such as contact 4 in FIG. 20 is provided with integral securing means such as upwardly formed inclined teeth, one tooth 4*a* at the near edge of contact 4 being shown in FIG. 20 and there being a similar tooth at the far edge of contact 4. Both inclined teeth 8*a* and 8*b* are shown for stationary contact 8 at the right-hand portion of FIG. 20. Alternatively, a pair of such teeth on each side or a series of teeth or serrations on each side could be used. An inclined projection 4*c*, 5*c* is provided on the lower surface of each contact-terminal that snaps behind the respective wall 3 of the housing as shown in FIG. 1. These stationary contacts are retained in place in the housing by an interference fit and plastic reflow to prevent removal thereof. For this purpose, the housing is provided with horizontal grooves in the external arc barriers on the left end and also on the right end as shown in FIGS. 2 and 3. These external arc barriers that separate the stationary contact-terminals from one another include four arc barriers 2*e–h* at the left side of the housing as shown in FIG. 3 and four external arc barriers 2*j–n* at the right side of the housing as shown in FIGS. 2 and 3. Each such external arc barrier such as 2*k* and 2*m*, for example, has a thinner portion at its outer end as shown in FIG. 3 and a thicker portion 2*p* and 2*q* extending inwardly therefrom so that the space between the thinner portions 2*k* and 2*m* is just wide enough to receive the stationary contact-terminal and the thicker portions 2*p* and 2*q* have shallow grooves therein to receive the edge portions including the inclined teeth of the stationary contact terminals. These grooves have smaller vertical height than the thickness of the stationary contact-terminals including the inclined teeth thereon so that when the stationary contact-terminals are inserted into place, the teeth will press into the upper edges of these grooves with an interference fit followed by plastic reflow to rigidly secure the stationary contact-terminals into place. Horizontal walls 3 of the housing have some resiliency and have inclined upper surfaces to lead the contact-terminals in their holes when inserted and to allow projections 4*c*, 5*c* to snap past the inner edges thereof.

As shown in FIG. 1, the terminal portion of each stationary contact-terminal 5 has a tapped hole therethrough into which is threaded a wire clamping screw 30 having a clamping plate 32 permanently secured thereto for clamping an electrical conductor to the terminal. In addition or alternatively, a quick connect terminal 34 may be secured by screw 35 to the stationary contact, quick connect terminal 34 having a tapered slot 34*a*, FIG. 3, for snap-in assembly on the screw and a pair of offset tongues or spade terminals onto which connector receptacles may be slidingly inserted, the opposite clamped surfaces thereof being grooved or ridged for good electrical connection and to allow assembly with the tongues at either upper or lower (FIG. 1) level. Alternatively, a "box" connector generally similar to that shown in W. H. Edmunds U.S. Pat. No. 3,066,277 may be used in place of screw 30 and plate 32.

Referring to FIGS. 1 and 2, it will be apparent that a frusto-conical compression, return spring 36 biases the armature and contact carrier subassembly upwardly. The upper small diameter end of return spring 36 bears against the lower surface of armature 28. The armature has a generally rectangular lug 28*b* on its lower surface as shown in FIGS. 7 and 8 formed by two shallow channels 28*c* and 28*d* extending across the lower surface of the armature on either side thereof for retaining the upper, smaller diameter end of return spring 36 in centered engagement with the armature, lug 28*b* being slightly shallower than pole faces 28*e* and 28*f* at the ends of the armature.

Figure 11:
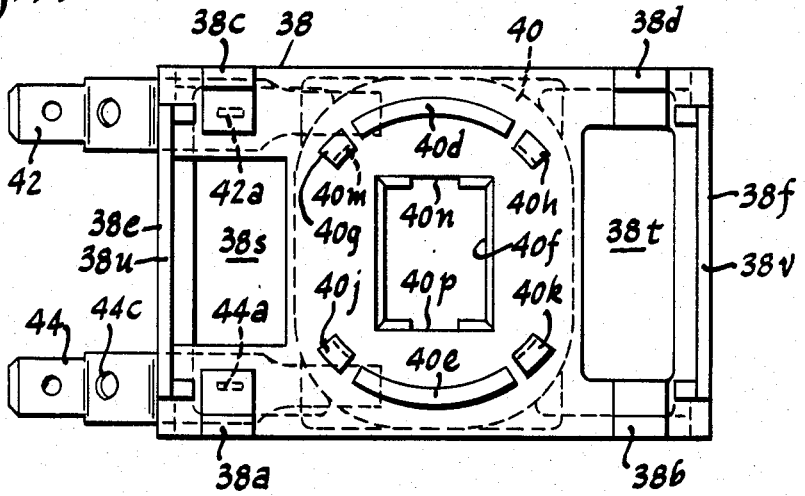
FIG. 11 is an enlarged top view of the encapsulated coil subassembly used in the contactor of FIG. 1.
Figure 12:
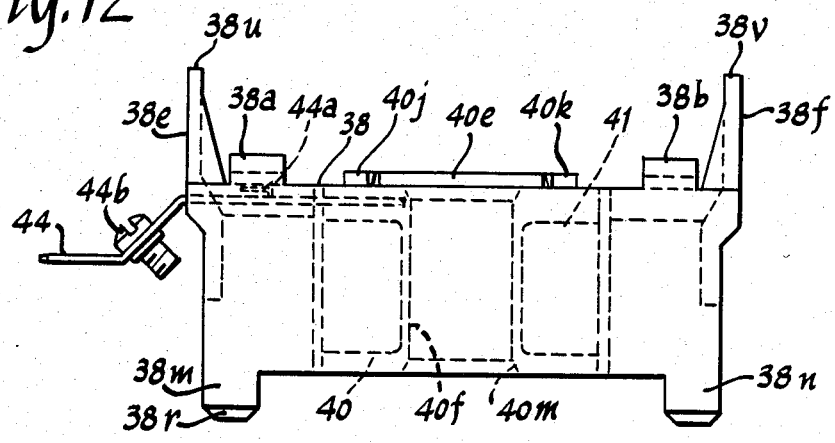
FIG. 12 is a front side view of the encapsulated coil subassembly of FIG. 11.

An operating coil subassembly 38 shown in FIGS. 2, 11, 12 and 18 presses against the lower, larger diameter end of return spring 36 and compresses this return spring to maintain the armature and contact carrier assembly normally in its uppermost position. As shown in FIGS. 11, 12 and 18, this operating coil subassembly 38 is made from a molded insulating coil bobbin 40, a pair of coil terminals 42 and 44 inserted into slots 40*a* and 40*b* in the coil bobbin, a coil wire connected to one of the coil terminals and wound around the bobbin a predetermined number of turns and then connected to the other coil terminal and both connections soldered, which is then embedded in molding material to provide the operating coil subassembly 38 shown in FIGS. 11 and 12. As shown in FIGS. 11 and 18, coil terminals 42 and 44 are each provided with a sheared hook 42*a*, 44*a*. The end of the coil wire is attached to one of these hooks and then wound around the bobbin as hereinbefore described and then attached to the other hook to form an operating coil 41 as shown in FIGS. 11 and 12. Thereafter, the ends of the coil wire may be secured as by soldering or welding to the terminal hooks to make good electrical connections.

Bobbin 40 shown in FIG. 11 is provided with means for snap-in retention of return spring 36. For this purpose, bobbin 40 is provided with a pair of arcuate ridges 40*d* and 40*e* on opposite sides of aperture 40*f* to guide the larger diameter end of the return spring therebetween when it is placed thereon in assembly. Bobbin 40 is also provided with two pairs of undercut projections 40*g*, 40*h* and 40*j*, 40*k* adjacent the opposite ends of ridges 40*d* and 40*e* for snap-in retention of the first turn of the spring when it is pressed therebetween. These projections are integrally molded on the bobbin so that the inwardly directed faces, such as face 40*m* shown in broken line, are angled downwardly and outwardly to provide recesses therebelow into which the first turn of the larger diameter end of the return spring is pressed. These projections are angularly spaced from one another on the periphery of a circle such that the first turn of the return spring must be squeezed slightly to snap it into place therebetween against the upper surface of the bobbin. The molded coil shown in FIGS. 11 and 12 is provided with means for interlocking it in the housing. For this purpose, the molded coil is provided with four upstanding lugs 38*a–d* that fit into complementary notches in the internal portions of the lower ends of the four depending legs of the housing, one of these notches 10*a* being shown in FIG. 1, two of these notches 10*a* and 10*b* being shown in FIG. 2 and two of these notches 10*a* and 10*c* being shown in the lower right-hand portion of FIG. 20. The encapsulated coil is also provided with a pair of upstanding end walls 38*e* and 38*f* as shown in FIGS. 11 and 12 that close the space at the opposite ends of the armature 28 as shown in FIG. 1. Also, the molded coil is provided with a bevel 40*m* at the bottom edge of the hole 40*f* in the bobbin, FIG. 12, to assist in leading the center pole of the magnet frame into this coil hole upon assembly and a pair of grooves 40*n* and 40*p* at opposite sides of the coil hole to provide clearance for rivet 46*a* of magnet frame 46, FIG. 13, upon assembly. In addition, the molded coil is provided with four short integral legs 38*m-n-p-q* as shown in FIGS. 2, 12 and 20. As shown in FIGS. 2 and 12, each of these legs terminates at its lower end in a thin section 38*r* tapered at its opposite ends that may be resiliently deformed when the frame is snap-in assembled onto the housing so as to take up any looseness between the parts. Screws such as 44*b*, FIG. 12, may be threaded into tapped holes 44*c* in the coil terminals for attaching electrical conductors thereto.

Figure 7:
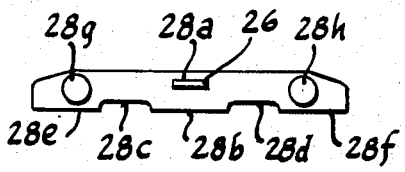
FIG. 7 is a front side view in actual size of the armature subassembly and its retaining spring used in the contactor of FIG. 1.
Figure 13:
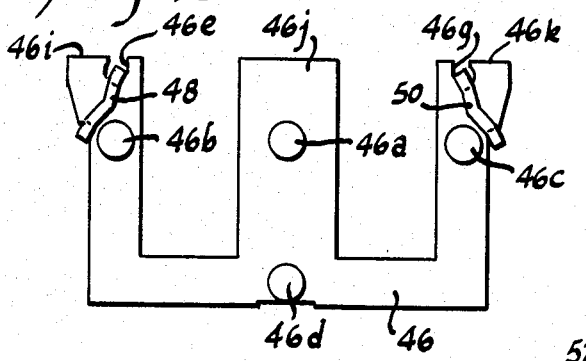
FIG. 13 is an enlarged front side view of the magnet frame subassembly used in the contactor of FIG. 1.

Both the armature subassembly shown in FIGS. 7 and 8 and the magnet frame subassembly shown in FIGS. 2 and 13 are made from a stack of ferrous metal magnetic laminations riveted together, the armature stack of laminations being riveted together by a pair of rivets 28*g* and 28*h* and the magnet frame subassembly stack of laminations being riveted together by four rivets 46*a–d*. The magnet frame subassembly shown in FIG. 13 is an E-shaped member having a generally rectangular center pole and the left and right end poles being formed to retain thereon shading coils 48 and 50. For this purpose, the left and right end poles are formed outwardly at their tips and are each provided with a pair of lateral grooves, the left pole being provided with an upper groove 46*e* and a lower groove 46*f* as shown in FIG. 19 and the right pole being provided with an upper groove 46*g* and a lower groove 46*h* into which the two shading coils 48 and 50 are secured as shown in FIG. 13. The two shading coils 48 and 50 are dropped into the upper notches of the left and right poles and are then crimped as shown in FIG. 13 so as to squeeze them tightly into the respective pairs of grooves to be rigidly secured therein.

As shown in FIG. 1, after the molded coil has been interlocked onto the housing, the magnet frame subassembly is dropped into the coil, this assembly taking place while the upper housing part 2 is preferably upside down. The center pole of the magnet frame subassembly fits freely but rather closely into hole 40*f* of the coil bobbin whereas the left and right outer poles of the magnet frame subassembly enter the rectangular apertures 38*s* and 38*t* in the molded coil shown in FIG. 11.

Figure 15:
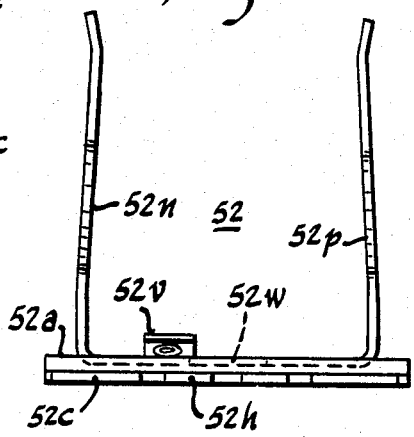
FIG. 15 is a right end view of the supporting and mounting frame of FIG. 14.
Figure 14:
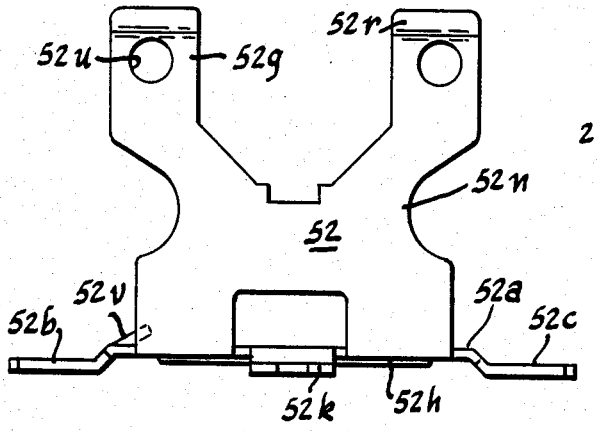
FIG. 14 is a front side view in actual size of the lower housing part or supporting and mounting frame used in the contactor of FIG. 1.

Referring to FIGS. 14 and 15, there is shown the lower housing part or frame which snap-in assembles to the upper housing part and holds all of the hereinbefore described parts together. This frame 52 which is made of metal such as steel or other material has a generally rectangular base 52*a* with the opposite end portions thereof 52*b* and 52*c* being offset slightly downwardly as shown in FIG. 13 and being provided with alternative mounting means such as respective pairs of oblong holes 52*d–g* as shown in FIG. 3 for receiving bolts, screws or the like for securing the contactor to a mounting panel. For this purpose, there is also provided at the right end of base 52*a* a notched tab 52*h* similarly offset slightly downwardly as shown in FIGS. 1 and 3, and a keyhole 52*i* at the left end. Forwardly and rearwardly extending notched tabs 52*k* and 52*m* are similarly offset slightly downwardly for like purposes as shown in FIGS. 1 and 3. Sides 52*n* and 52*p* of the U-shaped frame shown in FIG. 15 are each divided at their upper halves into a pair of arms 52*q–*52*r* shown in FIG. 14 and 52*s–*52*t* shown in FIG. 20 with each such arm having a round hole 52*u* therein shown in FIG. 14 so that complementary lugs 2*t* shown in FIG. 20 integrally molded on the housing snap into these holes when the frame is pressed over the magnet frame subassembly to complete the assembly of the contactor as shown in FIG. 1. As shown in FIG. 15, sides 52*n* and 52*p* of the frame are bowed slightly inwardly to ensure gripping of the housing therebetween and the tips thereof are bent at a small angle outwardly and the approach halves 2*u* of the lugs on the housing shown in FIG. 20 are beveled to facilitate sliding of the tips of the arms of the frame thereover until the lugs snap into the holes. A perforated "ground" tab 52*v* shown in FIGS. 1, 2 and 14 is sheared from base 52*a* of the frame and bent to an upward angle to provide for making a ground connection to the frame.

From the foregoing description of the parts of the contactor, it will be apparent that the parts of the contactor have been designed and constructed in such a manner as to facilitate and enable economical or automated assembly thereof without the use of screws or other similar fasteners by stacking the parts and subassemblies one upon another after the movable bridging contacts and their helical bias springs have been inserted into the contact carrier and by inserting the stationary contact-terminals into the holes in the housing.

The contactor may be assembled as follows. Initially, certain subassemblies must be made such as the operating coil 38 shown in FIG. 18 and the contact carrier 12 shown in FIG. 20. For the operating coil 38, coil terminals 42 and 44 are inserted into the appropriate slots in bobbin 40. The coil bobbin may be provided with either two or three terminal slots, three being shown in FIG. 18. The terminals are inserted into slots 40*a* and 40*b* if it is desired to have the terminals extending to one side of the operating coil subassembly as shown in FIG. 11. On the other hand, if it is desired to have the two coil terminals extending to opposite sides of the operating coil subassembly, the terminals will be inserted into slots 40*a* and 40*c* shown in FIG. 18. The coil wire is then attached to one terminal of the bobbin at hook 42*a* and wound onto the bobbin a predetermined number of turns and then attached to the hook on the other terminal whereafter the coil wire ends are soldered to the terminals. The wound coil bobbin is then encapsulated in a plastic molding material and screws such as 44*a* are turned into the tapped holes in the terminals to provide the completed operating coil shown in FIGS. 11 and 12.

The contact carrier subassembly is made of the parts shown in FIGS. 4, 5 and 17. First, the movable bridging contacts such as 16 shown in FIG. 17 are inserted into the windows 12*a*, 12*b* and 12*c* of the contact carrier molding. These movable bridging contacts may be inserted into the windows of the carrier by turning them on edge, inserting them halfway through the windows and then turning them back horizontal, or inserting them directly in the FIG. 6 version, and allowing them to settle to the bottoms of the windows as shown in FIG. 20. The movable bridging contact bias springs such as 22 shown in FIG. 17 are then inserted above the movable bridging contacts within the windows of the carrier as shown in FIG. 20. Next, armature retaining leaf spring 26 is inserted through the slot 28*a* in the armature and then this armature subassembly is assembled to the bottom of the contact carrier as shown by broken line BL1 in FIG. 20. This is done by pushing the ends of the armature retaining leaf spring into the locking notches at the bottom of the molded contact carrier.

Figure 16:
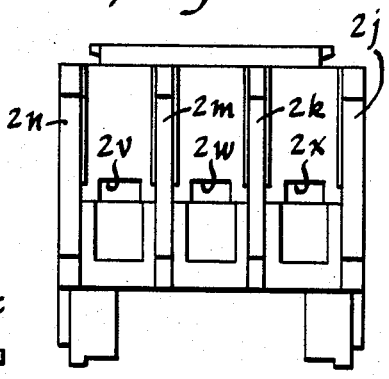
FIG. 16 is an actual size right end view of the upper housing part.

As shown by the broken line BL2 in FIG. 20, the contact carrier subassembly 12 is then inserted or dropped into upper housing 2. It will be apparent that armature 28 may be secured to contact carrier 12 either before the contact carrier is dropped into the housing or after it has been dropped into the housing. In either case, retainer leaf spring 26 is inserted through the slot in the armature and this subassembly is then placed on the contact carrier and moved laterally so that the ends of retainer spring 26 become locked in the locking slots of the contact carrier shown in FIG. 5. Thereafter, the stationary contacts such as 4 and 8 shown in FIG. 20, with the selected connectors preassembled thereon if desired, are inserted through the slots 2*v*, 2*w* and 2*x* in the ends of housing 2 shown in FIG. 16 so that the contacting portions thereof overlap the contacting portions of the movable bridging contacts within the contact compartment in the housing.

Another subassembly is made at this time by attaching the frusto-conical armature return spring to the encapsulated operating coil. This is done by placing the larger diameter end of return spring 36 between arcuate ridges 40*d* and 40*e* and squeezing the first turn at the larger diameter end of the return spring so that it will snap beneath the undercut portions such as 40*m* shown in FIG. 11 of retainer projections 40*g*, 40*h*, 40*j* and 40*k*.

This operating coil and armature return spring subassembly is then positioned over the armature and into interfitting engagement with the housing so that the tips of the end walls 38*u* and 38*v* enter into the spaces 2*y* and 2*z* between the end portions of the housing as shown in FIG. 20 and also the lugs 38*a–b* fit into the corresponding notches 10*a*, etc., in the legs of the housing to register and fix the encapsulated coil with respect to the housing. Then, magnet E-frame 46 with the shading coils preassembled thereon is dropped or inserted into the encapsulated coil so that the three poles thereof fall into the three holes in the encapsulated coil. Finally, mounting and supporting frame 52 is placed over the subassembly and pressed down so that the four lugs 2*t* of the housing enter and snap into the corresponding four holes 52*u* in the four arms of the supporting and mounting frame as shown in FIGS. 1 and 2. In this final assembly step, thin portions 38*r* at the ends of the four legs of the encapsulated coil shown in FIGS. 2 and 12 abut base 52*a* of the supporting and mounting frame and are resiliently deformed at least slightly to allow the snap-in assembly to be accomplished. In this manner, any looseness between the encapsulated coil and the housing is taken up so that the parts are held rigidly together.

While the apparatus hereinbefore described is effectively adapted to fulfill the objects stated, it is to be understood that the invention is not intended to be confined to the particular preferred embodiment of electromagnetic contactor disclosed, inasmuch as it is susceptible of various modifications without departing from the scope of the appended claims.

We claim:

1. An electromagnetic contactor constructed so as to enable economical assembly thereof without any screws or similar fasteners comprising:

an upper housing part of insulating material having an opening at the bottom and a contact compartment therein for slidably receiving and slidably accommodating a movable contact carrier and through-slots in opposite end walls thereof for receiving stationary contacts;

an insulating movable contact carrier having resiliently-biased movable contacts mounted thereon and constructed to be inserted or dropped into said contact compartment through said opening;

complementary inner walls in said contact compartment of said upper housing part and on said contact carrier for freely receiving said contact carrier into said contact compartment when dropped therein and guiding the same within said compartment for relative vertical actuation with respect thereto;

stationary contacts inserted with interference fit through said slots in said opposite end walls of said upper housing part into said contact compartment for engagement by said movable contacts when said contact carrier is actuated and terminals on said stationary contacts accessible on the outside of said upper housing part;

leaf spring retaining means at the bottom of said contact carrier;

an armature having a slot therethrough;

a retainer leaf spring inserted through said slot in said armature and pressed sideways at its ends into said leaf spring retaining means to securely clamp said armature to said contact carrier;

an electromagnet comprising an insulation encapsulated operating coil unit having interfitting portions with said upper housing part to maintain said coil unit fixed with respect to said upper housing part and a magnetic frame about the coil of said coil unit so as to magnetically attract said armature when said coil is energized;

an armature return spring between said coil unit and said armature;

a lower housing part placed over and secured to said upper housing part and embracing said magnetic frame and said coil unit to retain the same clamped with respect to said upper housing part with said return spring partly compressed between said coil unit and said armature;

and said insulation encapsulated coil unit comprising integral resilient abutments that are engaged by said lower housing part to take up looseness between said coil unit and said lower housing part and thereby hold said coil unit tightly against said upper housing part.

2. The electromagnetic contactor claimed in claim 1, wherein:

said upper housing part comprises internal arc barriers between said stationary contacts and external arc barriers between said terminals thereof;

and said contact carrier comprises arc barriers between said movable contacts and contiguous to and overlapping said internal arc barriers within said contact compartment.

3. The electromagnetic contactor claimed in claim 1, wherein:

said integral resilient abutments comprise a plurality of integral spaced legs having thin sections at their tips engaged by said lower housing part and capable of being resiliently stressed to take up any of said looseness between said parts.

4. The electromagnetic contactor claimed in claim 1, wherein:

said encapsulated coil unit comprises a pair of generally flat rectangular upstanding end walls having upper edges that abut said upper housing part and close the ends of the space surrounding the armature gap.

5. The electromagnetic contactor claimed in claim 4, wherein:

said encapsulated coil unit comprises a plurality of spaced lugs adjacent said end walls;

and said upper housing part comprises front and rear walls having a plurality of spaced complementary slots into which said lugs are received to fix said coil unit with respect to said upper housing part.

6. The electromagnetic contactor claimed in claim 1, wherein:

said upper and lower housing parts have complementary snap-in means operable to lock the same together when said lower housing part is placed over said upper housing part and pressed down.

7. The electromagnetic contactor claimed in claim 6, wherein:

said snap-in means comprises a pair of spaced retaining lugs at each of the front and rear sides of said upper housing part and a pair of spaced arms at each of the front and rear sides of said lower housing part, and said arms having holes therein for snap-in engaging said retaining lugs when said housing parts are pressed together.

8. The electromagnetic contactor claimed in claim 7, wherein:

said retaining lugs have inclined leading surfaces and said arms have angular ends and inward tension to facilitate the ends of said arms sliding over said retaining lugs leading to said holes for snap-in engagement.

9. The electromagnetic contactor claimed in claim 1, wherein:

said armature comprises a substantially flat elongated laminated magnetic member having a pair of pole faces on its lower surface;

and said contact carrier having a correspondingly elongated armature seat at the bottom thereof between said leaf spring retaining means.

10. The electromagnetic contactor claimed in claim 1, wherein:

said upper housing part comprises snap-in means at the top thereof for mounting a top adder auxiliary contacts unit and an aperture extending from said contact compartment through the top of said upper housing part;

and said contact carrier comprises a coupling portion extending up through said aperture for actuation of said auxiliary contacts unit.

11. The electromagnetic contactor claimed in claim 1, wherein:

said lower housing part comprises a generally rectangular base portion comprising a plurality of alternative mounting means including two pairs of laterally spaced perforated tabs for attaching said contactor to a mounting panel by two pairs of screws, laterally spaced keyhole opening and slotted tab for attaching said contactor to a mounting panel by a pair of screws, and a pair of rearwardly and forwardly directed slotted tabs for attaching said contactor to a mounting panel by a pair of screws.

12. The electromagnetic contactor claimed in claim 1, wherein:

said encapsulated coil unit comprises a center hole through said coil and a pair of holes on opposite sides of said coil;

and said magnetic frame comprises a laminated magnetic E-shaped member having three upstanding poles with the middle pole extending through said center hole and the two end poles extending through said pair of opposite holes to provide air gaps with respect to said armature pole faces.

13. The electromagnetic contactor claimed in claim 12, wherein:

each of said end poles of said magnetic frame has an outwardly offset portion and a pair of lateral grooves on opposite sides of said offset portion;

and a closed loop shading coil secured into said grooves so as to surround said offset portion.

14. The electromagnetic contactor claimed in claim 1, wherein:

said armature return spring comprises a frustoconical helical spring having a larger diameter end and a smaller diameter end;

and said encapsulated operating coil unit comprises snap-in means for removably gripping the first turn of said larger diameter end of said helical spring.

15. The electromagnetic contactor claimed in claim 14, wherein:

said snap-in means comprises a plurality of circularly arranged and angularly spaced projections on the top of said encapsulated operating coil unit, each having an undercut side, with the undercut sides of said plurality of projections being directed radially inwardly to receive said first turn of said larger diameter end of said helical spring.

16. The electromagnetic contactor claimed in claim 2, wherein:

said external arc barriers have opposed grooves receiving said stationary contacts with said interference fit;

and at least a pair of teeth formed on the edges of each said stationary contact biting into the edges of said grooves to securely retain said stationary contacts in place on said upper housing part.

17. The electromagnetic contactor claimed in claim 16, wherein:

each said stationary contact has a snap-in lug formed thereon;

and said upper housing part has a ledge beyond the inner edge of which said lug snaps to positively retain said stationary contacts in place.

18. The electromagnetic contactor claimed in claim 17, wherein:

said ledge has a beveled surface along which said lug slides when said stationary contact is inserted into said upper housing part to facilitate insertion thereof;

and said ledge is an integrally molded wall portion having some resiliency to allow said lug to be forced therealong into snap-in engagement with said inner edge thereof.

* * * * *